United States Patent [19]

Thompson

[11] Patent Number: 4,877,249

[45] Date of Patent: Oct. 31, 1989

[54] GOLF CLUB HEAD AND METHOD OF STRENGTHENING SAME

[76] Inventor: Stanley C. Thompson, 2702 S. Fairfax Ave., Culver City, Calif. 90232

[21] Appl. No.: 200,235

[22] Filed: May 31, 1988

Related U.S. Application Data

[63] Continuation-in-part of Ser. No. 31,535, Mar. 30, 1987, Pat. No. 4,775,156, and Ser. No. 929,099, Nov. 10, 1986, Pat. No. 4,756,534.

[51] Int. Cl.[4] ..... A63B 53/04; B23P 9/00; B23P 19/00; B32B 31/16

[52] U.S. Cl. ..... 273/169; 29/525.1; 29/445; 156/92; 273/174

[58] Field of Search ..... 273/171, 172, 174, 167 A, 273/169, 167 R, 167 F, 173, 175; 29/526.1, 445; 156/91

[56] References Cited

U.S. PATENT DOCUMENTS

| | | | |
|---|---|---|---|
| 1,000,982 | 8/1911 | Biddle | 273/174 |
| 1,349,806 | 8/1920 | Booth | 273/172 |
| 1,431,313 | 10/1922 | Lawton | 273/172 |
| 3,761,095 | 9/1973 | Thompson | 273/174 |
| 4,162,794 | 7/1979 | Thompson | 273/174 |
| 4,775,156 | 10/1988 | Thompson | 273/174 X |

FOREIGN PATENT DOCUMENTS

| | | | |
|---|---|---|---|
| 2169516 | 7/1986 | United Kingdom | 273/174 |

*Primary Examiner*—George J. Marlo
*Attorney, Agent, or Firm*—William W. Haefliger

[57] ABSTRACT

A golf club head is formed to have multiple laminations above a sole plate defining a keel; a bolt is connected to the sole plate at the keel and holds the laminations positively clamped together; and the keel forwardmost surface may be sloped to transfer ground impact force upwardly to the laminations via the sole plate, and also via the bolt. A vertical bore is formed in the head to receive the bolt, and the bolt is inserted into the recess and tightened to the sole plate above the keel, to compress the laminations. Synthetic resin also bonds the bolt to the compressed laminations, along the bolt length. The club head and bolt head are ground to provide a smooth top surface.

19 Claims, 5 Drawing Sheets

GOLF CLUB HEAD AND METHOD OF STRENGTHENING SAME

BACKGROUND OF THE INVENTION

This application is a continuation-in-part of Ser. No. 031,535, filed Mar. 30, 1987, now U.S. Pat. No. 4,775,156, and Ser. No. 929,099, filed Nov. 10, 1987, now U.S. Pat. No. 4,756,534. This invention relates generally to golf clubs, and more particularly concerns improvements in manufacturing woods which employ heads made up of stacked laminations, and metallic plates attached to the undersides of such heads. More specifically, it concerns improvements to the manufacture of the club heads of the type disclosed in my U.S. Pat. No. 3,761,095, disclosing a sole plate having a keel configuration.

When impact loads are transmitted to such metallic sole plates, the loads are typically transmitted to the wooden heads at points adjacent the plates. Where head laminations extend parallel to the plate, the load is transmitted t the few laminations adjacent the edges of the plate, and a tendency to destructive delamination can occur, particularly when a relatively immovable object such as a concealed rock is inadvertently struck. This problem is aggravated in that type of club disclosed in U.S. Pat. No. 3,761,095, wherein the sole plate carries a downwardly projecting keel which is more likely to strike objects concealed in the turf or ground. The attachment of such sole plates to the laminations as by screws is not an answer to the problem, since the edges of the threads form cracks in or between the laminations, encouraging delamination.

SUMMARY OF THE INVENTION

It is a major object of the invention to provide an improved method of strengthening a club head taking advantage of keel structure to modify same in such a way as to direct impact forces to benefit head durability, and weighting, in use. The method basically includes:

(a) providing a recess to extend generally vertically in the laminations from the sole plate upwardly, (b) inserting the bolt into said recess, and connecting the bolt with the sole plate at said keel, and rotating the bolt to clamp and compress the laminations, (c) and the bolt including flange means extending above said head top surface, and including the step of grinding said bolt head to form a lowered bolt head top surface flush with the top surface of the club head.

As will appear, the recess is typically formed by boring and counterboring, the counterbore receiving a flange means on the bolt and the bolt having a shank inserted into the bore below that counterbore; also, the flange means may typically comprise a bolt head integral with a shank defined by the bolt, and the shank lower end is typically rotated to become threadably attached and centrally of the sole plate at the keel. The sole plate may be formed to provide a second recess sunk downwardly therein, and into the keel body, and the bolt threading extended into said second recess; and adhesive bonding material is introduced into said bore and counterbore, bonding the bolt and flange means to the laminations which are wooden.

Also, the method of strengthening the head may include forming on the keel a forwardmost surface sloping upwardly and forwardly from the bottom of the keel, to intersect the front face at the lateral linear location substantially above the bottom level of the keel, whereby the keel sloping surface on striking the ground during a golf swing will transfer some force upwardly toward the head laminations. The method may also include forming on the head auxiliary upwardly and forwardly sloped surfaces laterally of the uppermost extent of said keel sloped surface, and which auxiliary surfaces intersect the head front face along lateral lines which are lateral continuations of the linear intersection of the keel sloped surface with said front face. Finally, weights may be located in the sole plate, fore and aft of the bolt receiving recess. These and other objects and advantages of the invention, as well as the details of an illustrative embodiment, will be more fully understood from the following description and drawings, in which:

DRAWING DESCRIPTION

Figure 4:
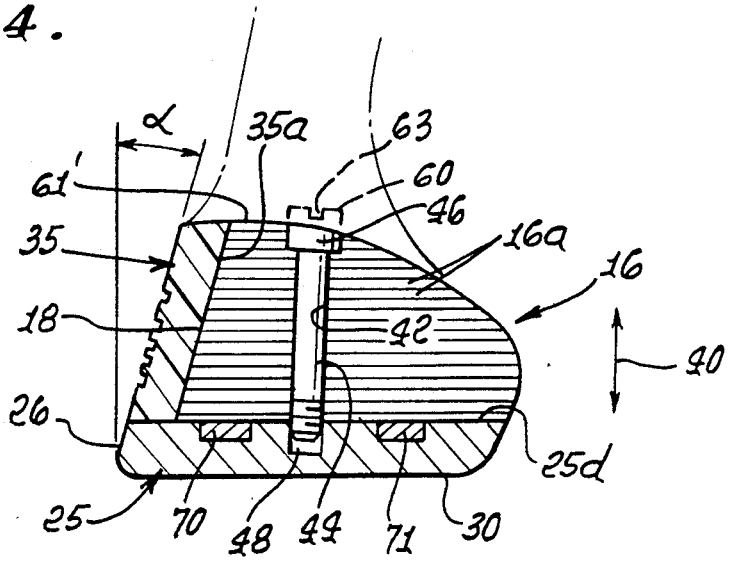
FIG. 4 is an elevation taken in section on lines 4—4 of FIG. 3.
Figure 4A:
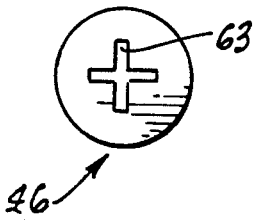
Figure 5:
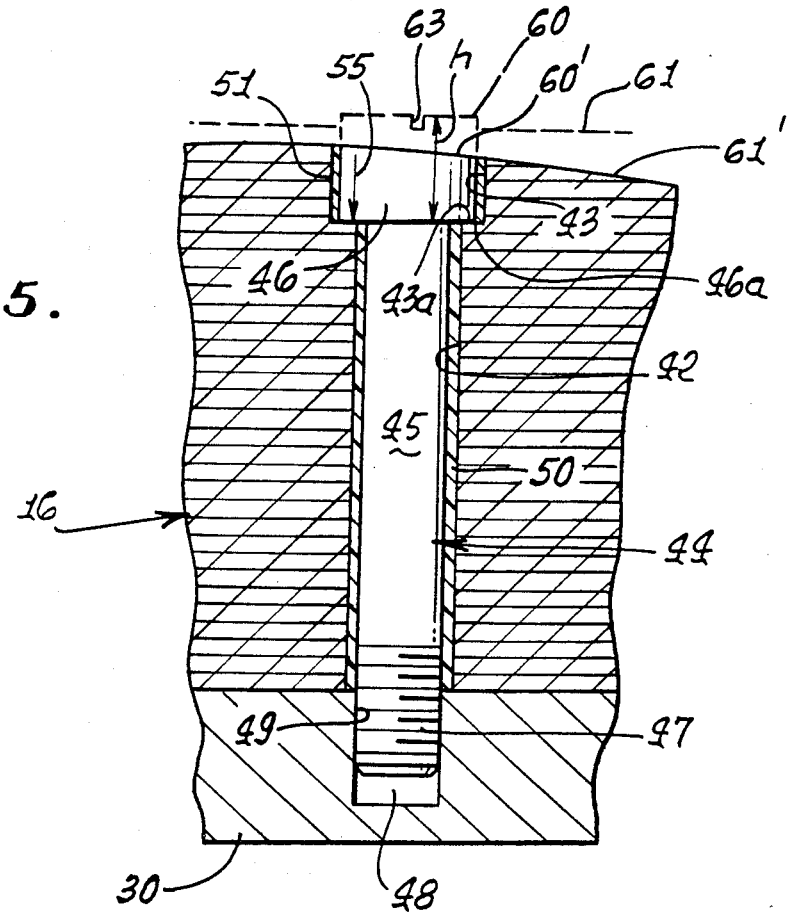
Figure 6:
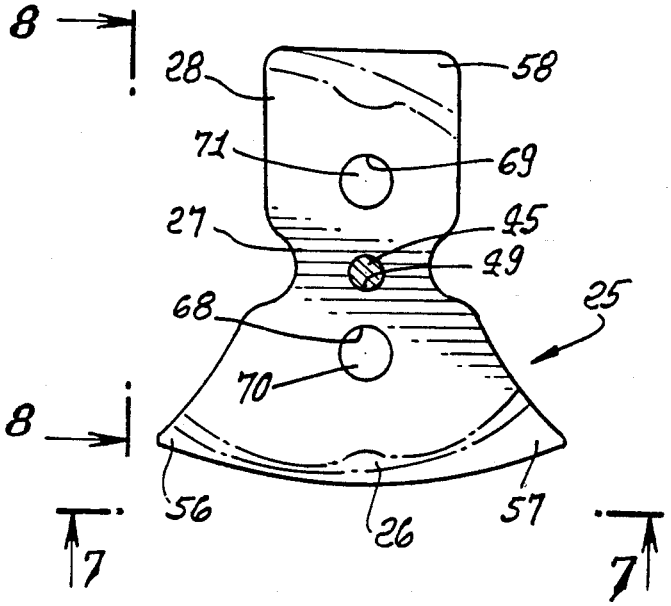
Figure 7:
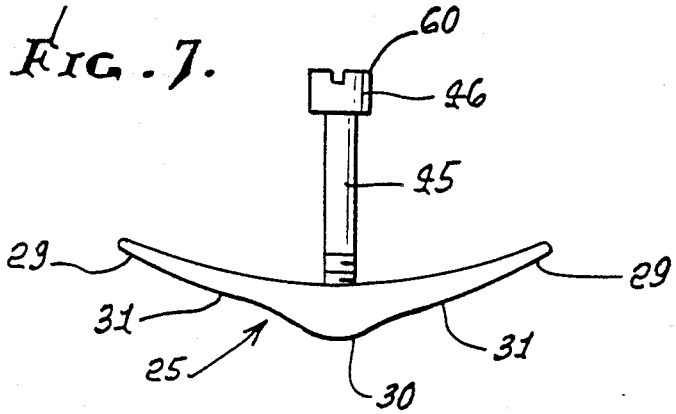
Figure 8:
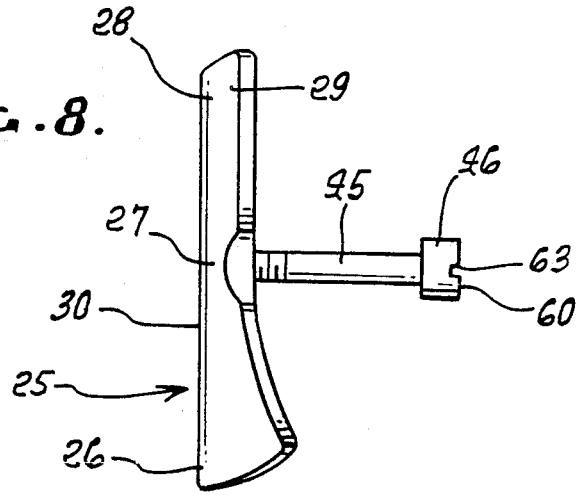
Figure 9:
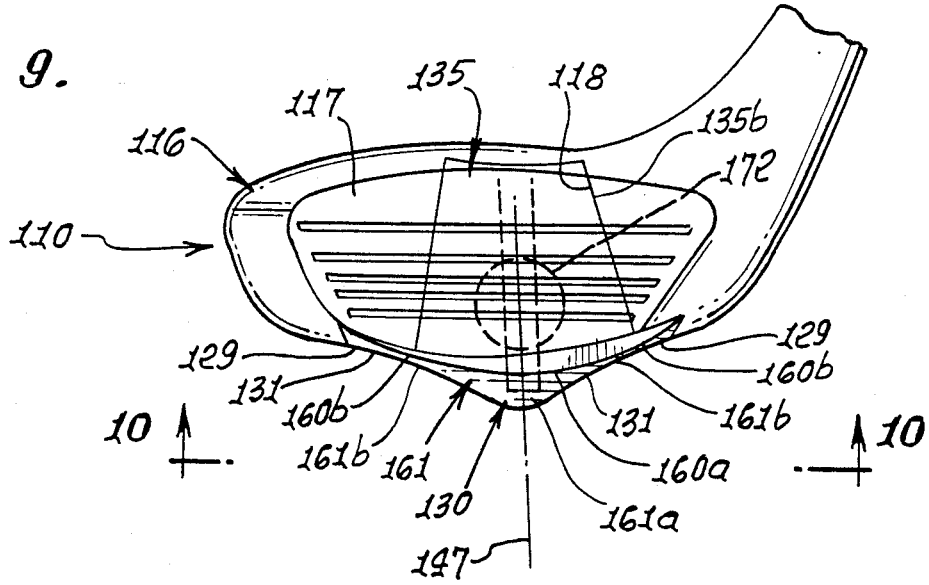
Figure 10:
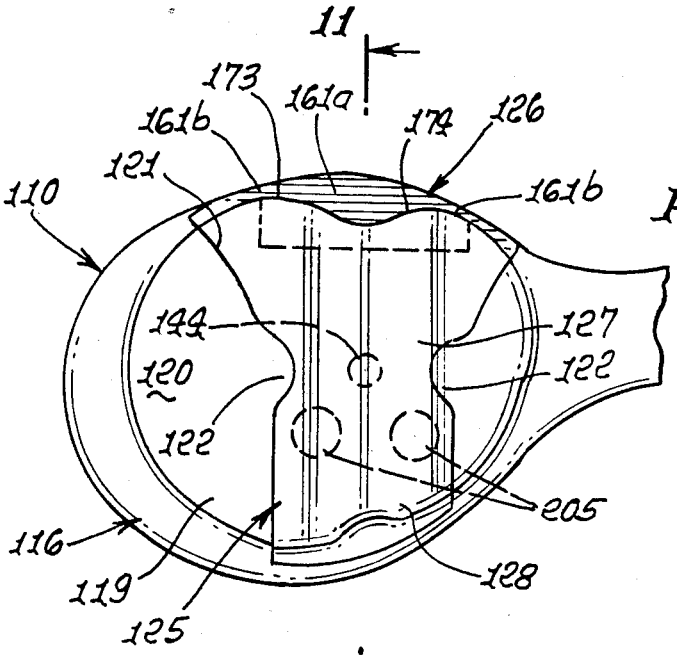
Figure 11:
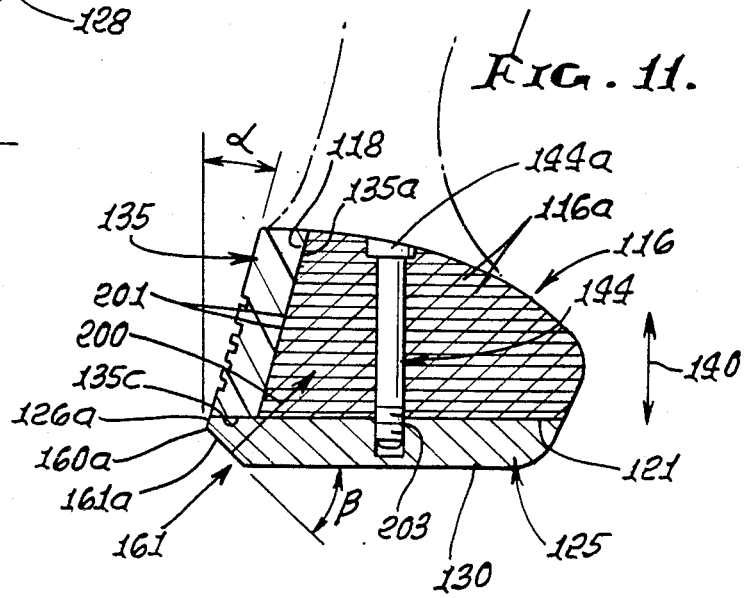
Figure 12:
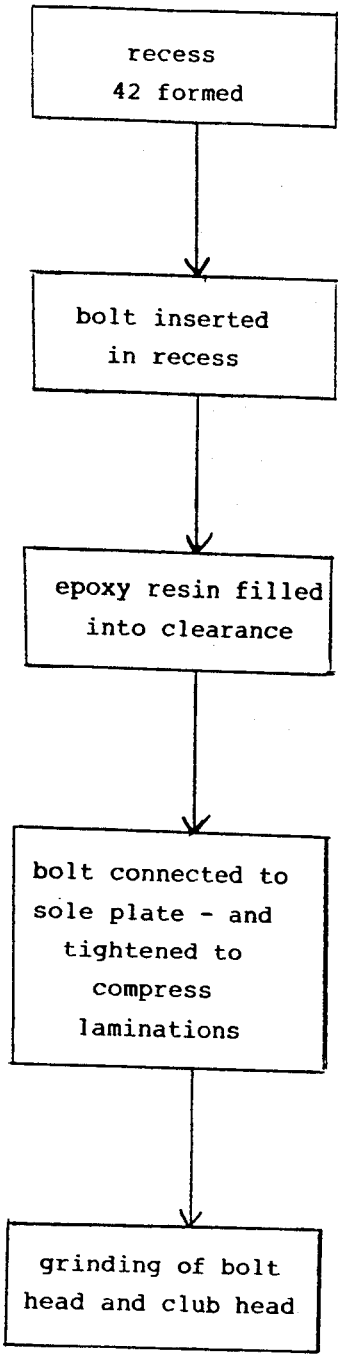

FIG. 4*a* is a top plan view showing the original surface of the bolt head;

FIG. 5 is an enlarged view of the bolt in position in the head;

FIG. 6 is a bottom plan view of the insert plate in as-molded condition, i.e. before trimming;

FIG. 7 is an end elevation on lines 7—7 of FIG. 6;

FIG. 8 is a side elevation on lines 8—8 of FIG. 6;

FIG. 9 is a frontal elevation showing a modified golf club "wood" head;

FIG. 10 is a bottom plan view on lines 10—10 of FIG. 9;

FIG. 11 is an elevation taken in section on lines 11—11 of FIG. 10;

FIG. 12 is a flow diagram

DETAILED DESCRIPTION

Figure 1:
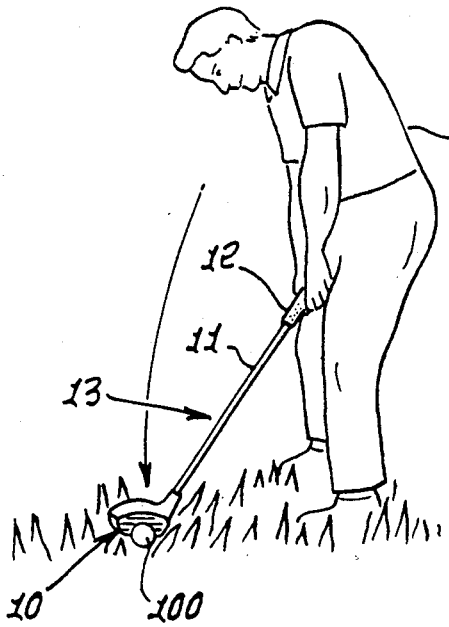
FIG. 1 is a frontal elevation showing use of the golf club.

Referring now to the drawings and particularly to FIG. 1, a golf club head embodying the present invention is generally indicated at 10 and is shown secured to a shaft 11. The latter has a conventional grip 12 to form an improved golf club 13. The club 13 is shown in hands of a golfer 14, just as the head 10 is about to engage the ball. At best seen in FIG. 2, the golf club 10 generally includes an upwardly extending shaft receiving hosel 15, a body 16, and a sole plate 25.

The golf club head 10 is shown in the preferred embodiment as being a "wood", with the wooden body 16 having front face 17. The latter may be of any conventional incline to vertical, as indicated by angle $\alpha$ in FIG. 4. The front face 17 has a centrally located cutout 18 for a trapezoidal panel 35. The body 16 is bulged at 19 behind the front face 17 as is a conventional for a wood. The body 16 also has a lower surface 20 with a cutout 21 for receiving the sole plate 25. The cutout 21 follows the shape of the sole plate 25 to be fitted therein, and has centrally located, opposed peninsulas 22 to locate the sole plate 25 with respect to the body 16. The sole plate may consist, for example of cast metal such as zinc or zinc aluminum alloy.

Figure 2:
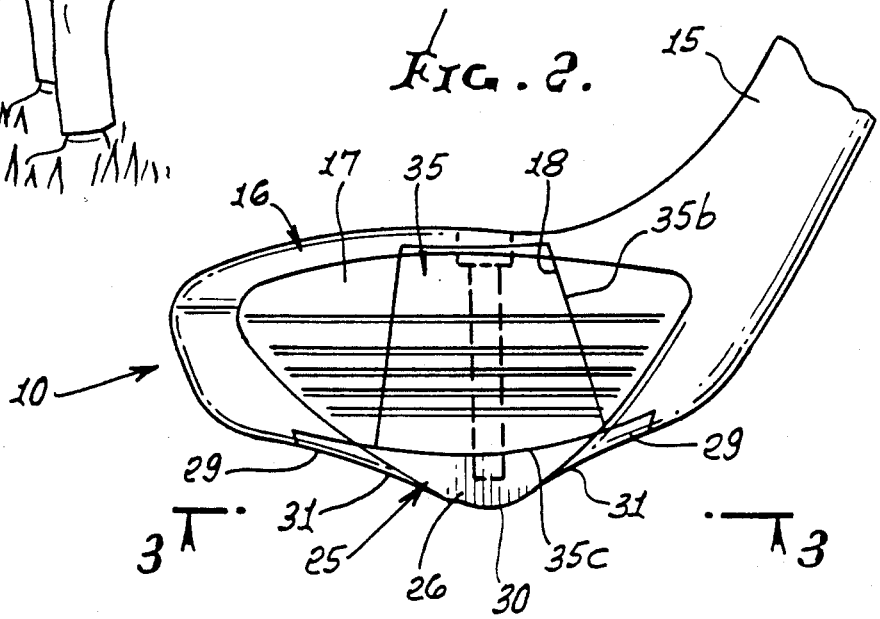
FIG. 2 is a frontal elevation showing a golf club head that incorporates the invention.
Figure 3:
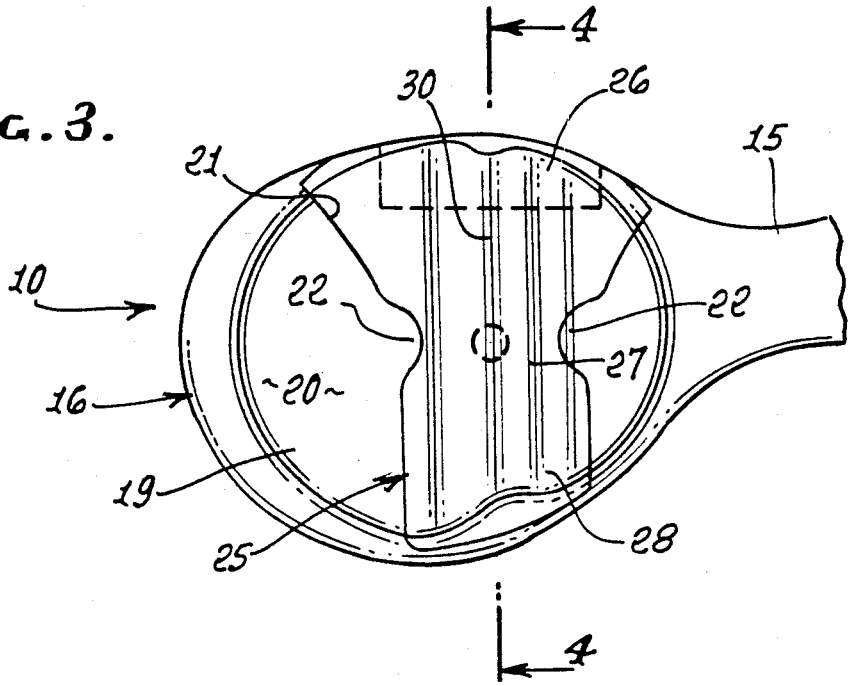
FIG. 3 is a bottom plan view on lines 3—3 of FIG. 2.

As best seen in FIGS. 2 and 3, the sole plate 25 is formed and shaped to mate with cutout 21 in the lower surface 20 of the body 16. The sole plate 25 has a shallow V-shaped front face 26 which, when the sole plate 25 is located in the cutout 21, provides an extension of the front face 17 of the body 16. The front face 26 is relatively wide and the sole plate 25 extends rearwardly therefrom to arrow into a waist 27 before spreading again at the rear end portion 28. The waist 27 mates with the centrally located opposed body peninsulas 22 to locate the sole plate 25 with respect to the body 16. The sole plate 25 is secured within the cutout 21 in the lower surface 20 of the body 16 by a bonding agent such as epoxy to bond the sole plate 25 and the body 16 together.

As will be described in FIGS. 914 11, and as also seen in FIG. 4, the keel front face is desirably formed to provide a forwardmost surface 126*a* sloping upwardly and forwardly from the bottom of the keel, to intersect the front face at a lateral linear location substantially above the bottom level of the keel, whereby the keel sloping surface on striking the ground during a golf swing will transfer some force upwardly toward the head laminations. The detailed construction of the surface at and laterally of the keel is described in FIGS. 9–11.

As seen in FIG. 2, the sole plate 25 has a lower surface 29 from which a longitudinally rearwardly and forwardly elongated keel 30 protrudes downwardly. In FIG. 3, the longitudinal keel 30 extends generally centrally from the front face 26 rearwardly along a line corresponding to the path of swing of the front fact of the golf club head 10. The bottom of the keel 30, being lowermost, typically contacts the ground before the ball 100 is struck to space the major portion 29 of the lower surface of the plate 25 and lower surface 20 of the body 16 from the ground. Thus the major area of contact with the ground is the bottom of the keel 30.

In the preferred embodiment, keel 30 is formed to have downwardly concave sides 31. (See FIG. 2). The concave sides 31 blend smoothly with the downwardly convex keel 30 and the major portion 29 of the lower surface of plate 25. They tend to set up a favorable air flow over the lower surfaces 29 and 30 of the club head 10 as the club 13 is swung through the air; further, as the head 10 passes through the air, the keel 30 splits the air ahead of the club head 10 and the concave sides 31 direct the air outwardly as it passes over the lower surfaces 29 and 20. This pattern of air flow tends to separate and bend the grass as the head 10 approaches the ball (see FIG. 1) rather than crush the grass as the conventional flat bottomed head does.

The golf club head 10 is completed by the insertion of the trapezoidal panel 35 in the cutout 18 on the front face 17 of the body 16. The panel 35 typically consists of a hard plastic material which can engage a ball repeatedly without becoming dented or worn as the wood of the body 16 would otherwise become if such a panel 35 were not provided. A suitable bonding agent such as an epoxide may be employed to bond the rear wall 35*a* sides 35*b* and bottom 35*c* of the insert to corresponding surfaces of the body and of the sole plate 25.

As shown in FIG. 4, the body 16 is typically defined by a vertical stack of generally horizontal and parallel laminations 16*a* consisting of wooden sheets bonded together at their interfaces. As an example, there may be between 17 and 19 such laminations per inch in the direction of arrows 40 in FIG. 4. The strength of the club head, to resist impact of the ball, is thereby enhanced. However, the rather shallow thickness of the sole plate, in the direction of arrows 40, causes stress concentration at the lowermost laminations 16*a*, i.e. those below the level of the upper surface 25*d* of the plate 25, since at times the full impact load of the club head against a concealed rock or other object is transmitted from the sole plate to such lowermost laminations. This can cause destructive delamination in the absence of the present invention.

In accordance with the method of the invention, and extending the description to FIG. 5, a recess is bored or formed generally vertically above the keel 30 in the laminations, from the sole plate upwardly. The recess typically defines a bore 42 and a counterbore 43. A bolt 44 is inserted into the recess and is connected with the sole plate directly above the bottom of keel 30; also the bolt is provided with flange means proximate the head top surface, i.e. within or inserted into the counterbore 43, while the bolt shank 45 is extended in bore 42. The bolt is tightened to clamp and compress the laminations toward one another between the flange means and the sole plate, thereby to positively prevent delamination, and also to transfer impact force from the sloping forward edge 26*a* of the keel to the laminations at the points of greatest compaction thereof, minimizing the risk of delamination.

More specifically, the flange means defines a bolt head 46 integral with the shank 45; and the lower end of the shank is externally threaded at 47 to threadably attach to the sole plate. As shown, the metallic sole plate forms a second recess 48 which is internally threaded at 40 to receive the bolt threads 47. The head includes a downwardly facing step shoulder 46*a* which clamps downwardly against the counterbore step shoulder 43*a*, when the bolt is tightened, to compress the laminations. See force arrows 55. Epoxy resin fills at 50 the clearance between the shank 45 and bore 42, and fills at 51 the clearance between head 46 and counterbore 43, the resin having been introduced into the clearances at the time of bolt assembly to the head. After curing, the resin locks the bolt to the head, whereby unthreading rotation of the bolt is prevented. Note that the depth of the sole plate at the keel allows the recess 48 to extend downwardly into the keel to a depth greater than the sole plate thickness at its peripheral regions that conform to the shape of cutout 21, whereby effective, high strength, generally centralized gripping of the sole plate by the bolt at threads 47 and 49 is achieved. The bolt typically consists of lightweight metal, such a aluminum, for example, whereby its presence in the club head i.e. the center of gravity of the head, is not raised. In this regard, the specific gravity of aluminum is 2.56, and the specific gravity of the sole plate zinc composition is about 6.85.

FIGS. 4 and 5 also indicate the original height "h" of the bolt head with a top surface at 60 extending above the original top surface level 61 of the wooden head. Note the slot 63 in the bolt head. Finish grinding of the club head, and bolt head, eliminates the slot 63 and lowers the bolt head top surface to level 60', flush with the reduced top surface level 61' of the wooden head.

FIG. 6 illustrates the provision of two additional openings 68 and 69 projecting in the sole plate 25 at opposite sides or recess 49, in the direction of club head travel. Such openings are of larger diameter than the diameter of the bolt shank 45. Concealed weights 70 and 71 are fitted in the recesses, as is clear from FIG. 5. The weights are typically bonded in position, in their associated openings and their specific gravities exceed the specific gravities of the bolt and sole plate. One example is tungsten. See also FIG. 4.

FIGS. 6–8 show the sole plate in as-cast condition, with ears 56 and 57 which are later partially cutaway or trimmed to match the contour of the wooden body 16, during assembly. The symmetric construction is such that the FIGS. 5–7 sole plate may be used on either left or right handed club heads.

As seen in FIGS. 9–11 a golf club head 110 is shown as being a "wood", with the wooden body 116 having front face 117. The latter may be of any conventional incline to the vertical, as indicated by angle $\alpha$ in FIG. 11. The front face 117 has a centrally located cutout 118 for a trapezoidal panel 135. The body 116 is bulged at 119 behind the front face 117 as is conventional for a wood. The body 116 also has a lower surface 120 with a cutout 121 for receiving the sole plate 125. The cutout 121 follows the shape of the sole plate 125 to be fitted therein, and has centrally located, opposed peninsulas 122 to locate the sole plate 125 with respect to the body 116. The sole plate may consist, for example of cast metal such as zinc or zinc aluminum alloy.

As best seen in FIGS. 9 and 10, the sole plate 125 is shaped to mate with cutout 121 in the lower surface 120 of the body 116. The sole plate 125 has a shallow V-shaped front face 126, which when the sole plate 125 is located in the cutout 121, provides a downward extension at **126*a* of the front face 117 of the body 116 above a line of intersection 160*a* of extension 126*a* with a rearwardly and downwardly sloping front surface 161. The front sloping front face 161 is relatively wide and the sole plate 125 extends rearwardly therefrom to narrow into a waist 127 before spreading again at the rear end portion 128. The waist 127 mates with the centrally located opposed body peninsulas 122 to locate the sole plate 125 with respect to the body 116. The sole plate 125 is secured within the cutout 121 in the lower surface 120 of the body 116 by a bonding agent such as epoxy to bond the sole plate 125 and the body 116** together.

As seen in FIG. 9, the sole plate 125 has a lower surface 129 from which a longitudinally rearwardly and forwardly elongated keel 130 protrudes downwardly. In FIG. 10, the longitudinal keel 130 extends generally centrally from the front face 126 and from sloping surface 161 rearwardly along a line corresponding to the path of swing of the front face of the golf club head 10. Note that rearward and downward (or upward and forward) sloping surface 161 has a middle portion **161*a* defined by the keel forwardmost extent, as well as side portions 161*b* which extend laterally beyond the keel forward surface 161*a*. The keel 130, being lowermost, typically contacts the ground before the ball is struck to space the major portion 129 of the lower surface of the plate 125 and lower surface 120 of the body 116 from the ground. In particular the keel "sled" surface 161*a* may impact the ground at an angle to minimize resistance to forward travel of the head, and also to transfer impact force upwardly and rearwardly toward the head laminations 116*a* and bolt 144 (corresponding to bolt 44) to minimize any tendency toward delamination, on impact. Note that the laminations generally forwardly of the bolt, and in the path of impact force arrow 200 from keel angled surface 161*a*, are held in clamped together condition by the bolt, and by thin adhesive bonding at 201 to panel 135, preventing delamination. Also, surface portions 161*b***, being rearward and downwardly sloped, enhance these effects.

In the preferred embodiment, keel 130 has downwardly concave sides 131. (See FIG. 9). The concave sides 131 blend smoothly with the downwardly convex keel 130 and the major portion of the lower surface 129 of plate 125 and they merge with sloped surfaces **161*a* and 161*b*. They, and the sloped surfaces, tend to set up a favorable air flow over the lower surfaces 129 and 130 of the club head 110 as the club 13 is swung through the air; further, as the head 110 passes through the air, the keel 130 splits the air ahead of the club head 110 and the concave sides 131 direct the air outwardly as it passes over the lower surfaces 129 and 120. This pattern of air flow tends to separate and bend the grass as the head 110** approaches the ball (see FIG. 9), rather than crush the grass as the conventional flat bottomed head does.

The golf club head 110 is completed by the insertion of the trapezoidal panel 135 in the cutout 118 on the front face 117 of the body 116. The panel 135 typically consists of a hard plastic material which can engage a ball repeatedly without becoming dented or worn as the wood of the body 116 would otherwise become if such a panel 135 were not provided. A suitable bonding agent such as an epoxide may be employed to bond the rear wall **135*a*, sides 135*b* and bottom 135*c* of the insert to corresponding surfaces of the body and of the sole plate 125**.

As shown in FIG. 11, the body 116 is typically defined by a vertical stack of generally horizontal and parallel laminations **116*a* consisting of wooden sheets bonded together at their interfaces. As an example, there may be between 17 and 19 such laminations per inch in the direction of arrows 140 in FIG. 11. The strength of the club head, to resist impact of the ball, is thereby enhanced. However, the rather shallow thickness of the sole plate, in the direction of arrows 140, causes stress concentration at the lowermost laminations 116*a*, i.e. those below the level of the upper surface 125*d* of the plate 125**, since at times the full impact load of the club head against a concealed rock or other object is transmitted from the sole plate to such lowermost laminations.

It will be noted that the sloped auxiliary surfaces **161*b* intersect the head front face along lines 160*b* which are lateral continuations of the linear intersection 160*a* of the keel sloped surface 161 with the front face 117. That line of intersection extends laterally along at least about half the head front face lateral dimension, and it is located between about $\frac{1}{8}$ and $\frac{1}{4}$ the height of the head as measured upwardly from the bottom of the keel and toward the uppermost extent of the front face. Further, keel sloping surface 161 extends at an angle $\beta$ between about 40° and 50° relative to the head bottom surface that lies horizontally. Note also that sloped surface 161 is below the sweet spot, generally indicated at 172**, in FIG. 9, i.e. the preferred and centered ball striking surface, generally circular.

The keel concave opposite sides 131 intersect the auxiliary sloping surfaces **61*b* along lines of intersection 173 and 174. Surfaces 161*b*** curve laterally, rearwardly an upwardly, while also sloping downwardly and rearwardly. Accordingly, force of impact with the ground is transmitted upwardly and rearwardly, toward the pre-compressed (by the bolt), clamped together laminations, tending to compact them, not "delaminate" them as by shear. Such sloping assists forward travel of the head despite keel impact with the turf or ground. Also, major forces are transmitted from the sloping surfaces to the bolt and to the laminations at points where they are most highly pre-compressed and clamped, positively preventing delamination.

In summary, and as seen in FIGS. 9–11, the golf club head is characterized and formed so that:

(a) the keel 110 has a forwardmost surface 161*a* sloping upwardly and forwardly from the bottom thereof and intersecting the front face 117 to define a line of intersection 160*a* substantially above the bottom level of the keel, whereby the forwardmost sloping surface 161*a* on striking the ground during a golf swing wall transfer some force upwardly toward the head laminations tending to compress same and prevent delamination, (b) the head also having auxiliary upwardly and forwardly sloped surfaces 161*b* laterally of and merging with the uppermost extent of the forwardmost sloped surface, and which auxiliary surfaces intersect the head front face along lateral lines 160*b* which are lateral continuations of the line of intersection 160*a* of the forwardmost sloped surface with said front face, (c) the forwardmost sloping surface 161*a* of the keel extending at an angle between about 40° and 50° relative to said straight surface portion of the keel, the surface of said head between said lateral lines of intersection 160*b* at the front face and (173,174) at the underside of the keel vertically therebelow defining an angle between about 40° and 50° relative to said straight surface portion of the keel, (d) the forwardmost sloping surface 161*a* intersecting the bottom of the keel at said straight surface portion thereof and being substantially greater in height than the heights of said auxiliary surfaces 161*b*, the bottom of the keel being at the lowest level of the entire head, (e) the keel having opposite sides 131 which slope upwardly and laterally, rearwardly of said forwardly and upwardly sloping front surface, said opposite sides being downwardly concave, (f) the lateral lines of intersection 160*b* being spaced above the level of the merging of the keel opposite sides with the head bottom surface, and above the levels of such concave sides.

(g) and a bolt 144 passing downwardly through head laminations, into the central body of the keel, rearwardly of sloped surface 161, the bolt threadably retained at 203 to the central body of the keel, and the bolt having a head 144*a* clamping downwardly on the laminations at the top of the head. The bolt is rearward of sweet spot 154.

Head weight may be employed as at 205, in the laminations. A vertical central plane appears at 147, in FIG. 9.

I claim:

1. The method of strengthening a golf club head having laminations which extend in vertically stacked relation, and generally horizontally, the head having a front face, bottom and top surfaces, and a metallic sole plate having a keel extending generally forwardly at the bottom of the head, the method including:

(a) forming on the keel a forwardmost surface sloping upwardly and forwardly from the bottom of the keel, to intersect the front face at a lateral linear location substantially above the bottom level of the keel, (b) forming a hole in the laminations vertically between the top of the head and the keel, rearwardly of said forwardmost sloping surface, (c) and clamping said laminations by bolting them together directly above the keel, and rearwardly of said forwardmost sloping surface, said bolting step including introducing a bolt downwardly into said hole and rigidly connecting the lower end of the bolt to the sole plate directly above the keel and at substantially the level of the keel forwardmost sloping surface so that a normal to said sloping surface intersects said bolt, whereby the keel forwardmost sloping surface, upon striking the ground during a golf swing, will transfer force upwardly and rearwardly toward the bolt via the head laminations.

2. The method of claim 1 including also forming on the head auxiliary upwardly and forwardly sloped surfaces laterally of the uppermost extent of said keel sloped surface, and which auxiliary surfaces intersect the head front face along lateral lines which are lateral continuations of the linear intersection of the keel sloped surface with said front face.

3. The method of claim 1 wherein said keel sloping surface is formed by beveling to extend at an angle between 40° and 50° relative to said head bottom surface that lies horizontally.

4. The method of claim 1 including carrying out said bolting step to locate the keel below a lower center portion of said front face.

5. The method of claim 1 wherein said keel is formed to have opposite sides which slope upwardly and laterally, rearwardly of said forwardly and upwardly sloping front surface of the keel, and which sides intersect said front surface, and wherein said opposite sides are formed as concave upwardly.

6. The method of claim 5 wherein said lateral lines of intersection are formed to be spaced above the level of the merging of said keel opposite sides with the head bottom surface.

7. The golf club head formed by the method of claim 1.

8. In the method of positively integrating a golf club head having multiple laminations which extend in vertically stacked relation, and generally horizontally, the head having a front face, a top surface, and a metallic sole plate extending beneath the laminations, the sole plate having a downwardly projecting keel which extends rearwardly relative to the front face of the head, and employing a bolt, the method that includes:

(a) providing on the keel a forwardmost surface sloping upwardly and forwardly from the bottom of the keel, to intersect the front face at a lateral linear location substantially above the bottom of the keel, and providing a recess to extend generally vertically in the laminations from the sole plate upwardly, rearwardly of said sloping surface, (b) inserting the bolt into said recess, and rigidly connecting the bolt with the sole plate at said keel, and rotating the bolt to clamp and compress the laminations, and at locations between the bolt and said forward most sloping surface whereby the keel forwardmost sloping surface, upon striking the ground during a golf swing, will transfer force upwardly and rearwardly toward the bolt via the compressed laminations, defining a head.

(c) and the bolt including flange means extending above said club head top surface, and including the steps of bonding the bolt to the compressed laminations along the length of said recess, and grinding said bolt head to form a lowered bolt head top surface flush with the top surface of the club head.

9. The method of claim 8 wherein the bolt head before the grinding step has notching sunk in its top surface, the bolt rotation effected by inserting a tool in said notching and rotating the tool, and said grinding step is carried out to remove said notching.

10. The method of claim 8 including employing synthetic resin to bond the bolt to club head surfaces bounding said recess.

11. The method of claim 8 including extending the recess into the sole plate to penetrate the keel above the keel lowermost extent, and thread connecting the bolt to the sole plate at the recess in the sole plate.

12. The golf club head formed by the method of claim 11.

13. The method of claim 8 wherein said recess is formed by boring and counterboring to define a bore and counterbore, the bolt having flange means, the counterbore receiving said flange means, and the bolt having a shank received in the bore below said counterbore.

14. The method of claim 13 including adhesively bonding the bolt and flange means to the laminations which are wooden, in the bore and counterbore.

15. The method of claim 8 including providing said bolt to consist of lightweight metal, and the sole plate to consist of metal of greater specific gravity than the bolt.

16. The method of claim 8 including forming at least one recess in the sole plate and spaced from the bolt in the fore and aft direction of the keel, introducing a weight into said recess of greater specific gravity than the specific gravities of the sole plate and bolt, forming a second recess in the sole plate at the side of the bolt opposite that of said one recess, and introducing a second weight in the second recess.

17. The method of claim 8 wherein the sole plate has underside faces at opposite sides of the keel, each face having downward concavity, and including forming a recess extension into the keel for receiving the bolt, and locating the recess between said underside faces having said downward concavity.

18. The method of claim 8, including rigidly attaching the club head to a golf club shaft, and swinging the golf club to cause said keel forwardmost sloping surface to strike the ground as the head front face approaches a golf ball, and transferring ground impact force from said front face to said compressed laminations via said keel and the bolt bonded to the laminations.

19. The golf club head formed by the method of claim 8.

* * * * *